United States Patent [19]

Broadbent

[11] 4,010,806

[45] Mar. 8, 1977

[54] ROCK BOLTING EQUIPMENT

[75] Inventor: Kenneth Joseph Broadbent, Speers Point, Australia

[73] Assignee: The Titan Manufacturing Company Proprietary Limited, Newcastle, Australia

[22] Filed: Nov. 16, 1972

[21] Appl. No.: 307,228

[52] U.S. Cl. ..... 173/57; 173/161; 173/169; 173/170

[51] Int. Cl.[2] ..... E21C 1/10

[58] Field of Search ..... 173/57, 170, 161, 159, 173/152, 153, 36, 169

[56] References Cited

UNITED STATES PATENTS

| | | | |
|---|---|---|---|
| 1,682,438 | 8/1928 | Stuthridge et al. | 173/57 X |
| 2,320,874 | 6/1943 | Lehman | 173/158 X |
| 2,461,528 | 2/1949 | Curtis | 173/161 X |
| 2,689,547 | 9/1954 | Pearson | 173/161 X |
| 2,804,751 | 9/1957 | Schroeder | 173/36 R |
| 2,843,361 | 7/1958 | Miller | 173/158 X |
| 3,105,416 | 10/1963 | Hecke | 173/169 |
| 3,275,089 | 9/1966 | Kaiser et al. | 173/170 X |
| 3,571,874 | 3/1971 | Von Arx | 173/169 |

*Primary Examiner*—Ernest R. Purser
*Assistant Examiner*—William F. Pate, III

[57] ABSTRACT

Equipment for drilling holes in mine roofs for the purpose of rock bolting comprises an intermediate portion having mounted on and extending from it at one end a telescopic leg and mounted on and extending from it at the other end a drill rod, a hydraulic motor mounted on the intermediate portion and coupled to the drill rod, first valve means adapted to be connected to a pressure fluid source for supplying pressure fluid to the leg for extending it or for releasing fluid from the leg, second valve means adapted to be connected to a pressure source for supplying pressure fluid to the hydraulic motor for driving it or for releasing fluid from the motor and means for controlling the first and second valve means.

7 Claims, 7 Drawing Figures

ROCK BOLTING EQUIPMENT

This invention relates to equipment for drilling holes in mine roofs for the purpose of rock bolting. Rock bolting is the process of securing in each hole, a rock bolt for the purpose of holding together the roof structure and reducing the necessity for the use of props and other timbering.

In modern times using expensive coal winning machinery it is necessary, after coal winning at the face has been carried on within safe limits, for the machinery to be withdrawn from the face so that the newly exposed roof can be rock bolted. This takes some time during which the coal winning function of the coal cutting machinery must be suspended.

The principal object of the present invention is to provide roof drilling equipment which would enable this lost time for the coal winning machinery to be cut to a minimum.

A further object of the invention is to make use of the means on the coal cutting machinery providing high pressure hydraulic oil for feeding winning equipment. The use of hydraulic motors instead of pneumatic motors makes it unnecessary to pipe compressed air long distances.

A further object is to provide a single portable unit means for dry drilling holes, means for wet drilling holes when required and means for maintaining the required drilling pressure against the base of the hole.

In one general form the invention is drilling equipment comprising an intermediate portion having mounted on and extending from it at one end a telescopic leg and mounted on and extending from it at the other end a drill rod, a hydraulic motor mounted on the intermediate portion and coupled to the drill rod, first valve means adapted to be connected to a pressure fluid source for supplying pressure fluid to the leg for extending it or for releasing fluid from the leg, second valve means adapted to be connected to a pressure source for supplying pressure fluid to the hydraulic motor for driving it or for shutting off the supply of pressure fluid to the motor for stopping it, a control arm pivotally connected at one end to the intermediate portion and having at its outer end means for controlling the first and second valve means independently of each other.

One preferred form of the invention is shown in the accompanying drawings in which.

Figure 1:
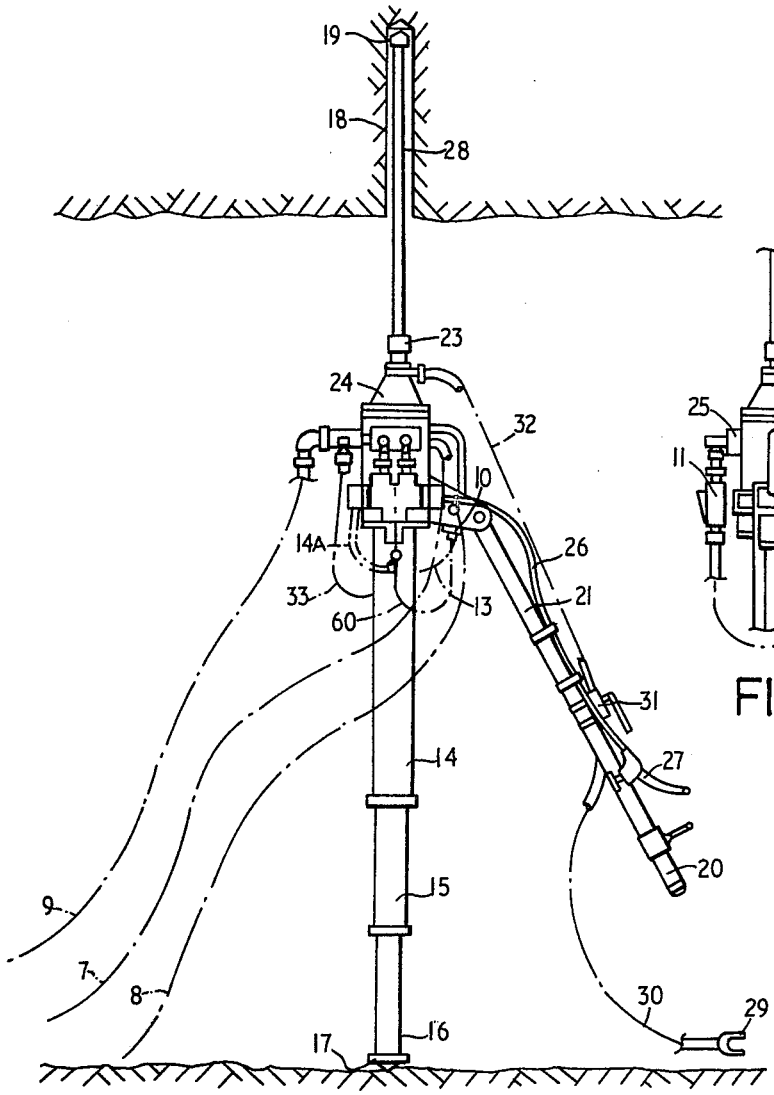
FIG. 1 is a general view showing components of the unit.
Figure 1A:
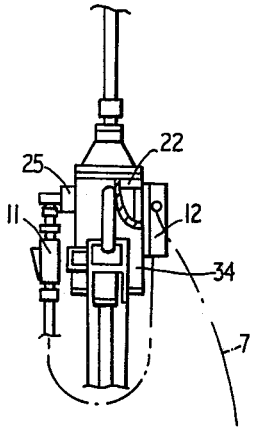
FIG. 1A is a detail view near the intermediate portion.

We refer first to FIGS. 1 and 1A. In use, the equipment is erected in the upright position as shown in FIG. 1. Individual components are shown by reference numerals on the drawing. The principal parts are as follows:

Hoses 7, 8 and 9 feed hydraulic oil under pressure to or from the drill components. Valves 10 and 11 are for controlling the flow of hydraulic oil to the drill components. Valve 12 is for dividing the oil supply from the hose 7 into two separate circuits, one of which is a pressure relieved set flow to the valve 10 through a hose 13 and the other, the remaining flow from the hose 7 to the valve 11 through a hose 14A.

Oil directed from the valve 10 through a hose 60 to the telescopic cylinder body 14 displaces telescopic components 15 and 16 causing the unit to extend until a pad 17 is firmly resisted by the ground and a drill rod 18 carrying a drill bit 19 engages the roof. Operation of the valve 10 is by twist grip 20 on the end of a control arm 21.

The drill rod 18 is coupled to a hydraulic motor 22 through a chuck 23, and a spindle in a wet drilling unit 24 containing bearings. Oil directed from the valve 11 through fittings to an adaptor block 25 drives the hydraulic motor 22 and returns to the reservoir of the power source through the return line hose 9. Operation of the valve 11 is by a bowden cable 26, and hand lever 27.

When the required hole 28 has been drilled, retraction of the unit is effected by allowing the oil in the telescopic cylinder to escape back through hose 60, valve 10 and non restricted hose 8 directly to the power source reservoir.

Rotation is stopped by diverting oil from the valve 11 directly into the power source return line 9, thereby bypassing the hydraulic motor 22.

Water, if necessary for dust suppression and swarf removal, is supplied to a hose clip 29 and directed through a hose 30, an ON/OFF water cock 31 and a hose 32 to the end of the drill rod 18 within the wet drilling unit 24.

Oil from the pressure relief valve within the valve 12 is drained through a hose 33 into the power source return line 9.

Figure 2:
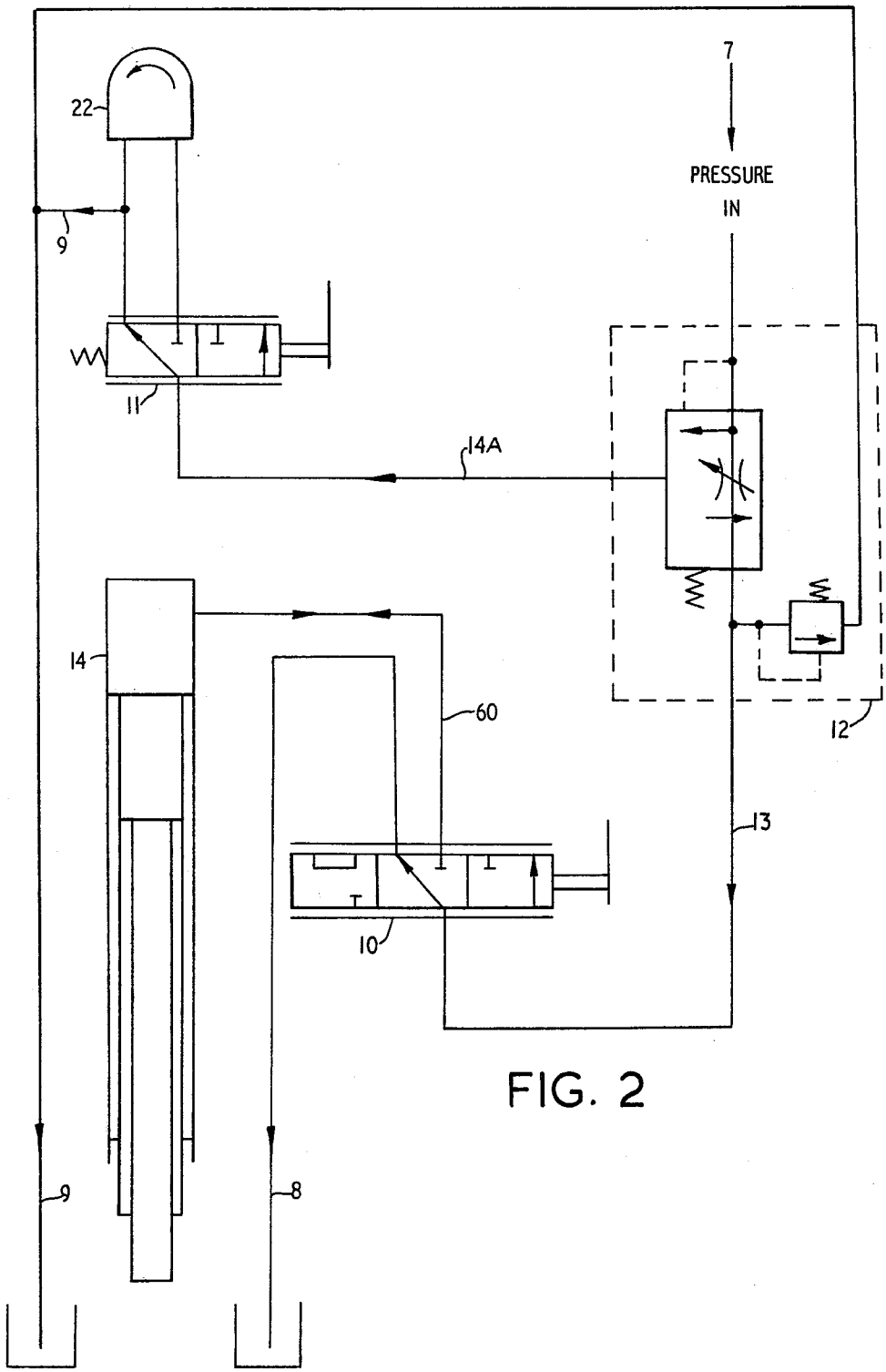
FIG. 2 is a diagrammatic view of the hydraulic circuit.

FIG. 2 shows the hydraulic circuit in schematic form. It will be seen that oil under pressure passes into the priority flow control valve 12 and is divided into two separate circuits, one of which is a priority circuit which is set at a gallonage suitable to the desired speed at which the components of the cylinder 14 are to displace. This priority circuit has an integral pressure relief valve set to relieve at a predetermined thrust resistance. Manual control of this circuit is effected by the control valve 10 which is depicted in the position where the cylinder 14 is locked at a set extension.

The second circuit consists of the remainder of the oil supplied to valve 12 which is delivered to the hydraulic motor 22 through the control valve 11 depicted in the OFF position.

Hose 9 represents the power source return line and hose 8 represents the non restricted oil line returning directly into the power source reservoir.

Figure 3:
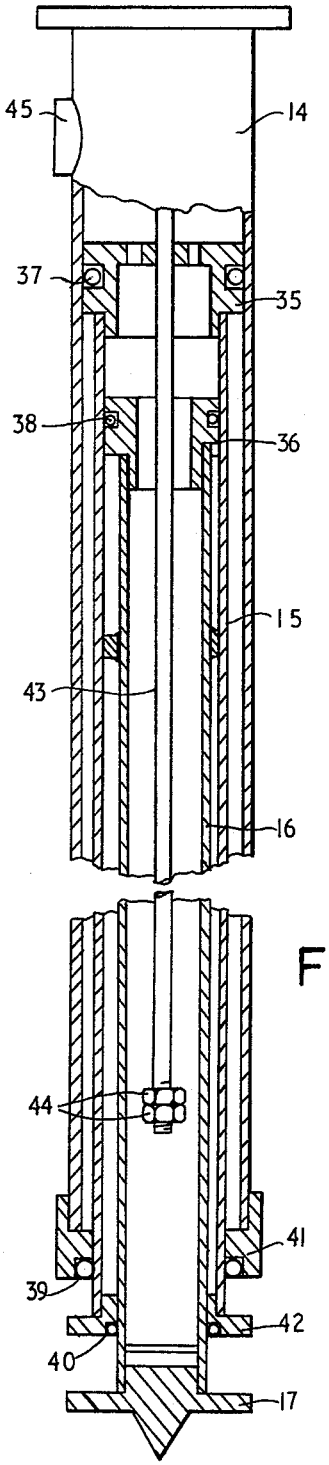
FIG. 3 is a sectional view of the hydraulic thrust cylinder which provides telescopic extension of the unit.

We refer next to FIG. 3. The cylinder body 14, while providing mountings for the motor shell 34 (FIG. 1) also provides the bore for the travel cylinder flange 35 secured to the travel cylinder 15. The travel cylinder 15 in turn provides the bore for the support leg flange 36 secured to the support leg 16. Seals 37 and 38 retain the oil within the leg and seals 39 and 40 exclude dust.

Sleeves 41 and 42 provide lateral support for the lower ends of the leg components and the end pad 17 is a floor pad to support the unit. A stop shaft 43 - acts as a stop for the travel cylinder 15 which in turn acts as a stop for the support leg 16. Limit stop nuts 44 are secured to the end of the stop shaft 43. Flange 45 provides a threaded entrance port for the oil hose 60 (FIG. 1).

Figure 4:
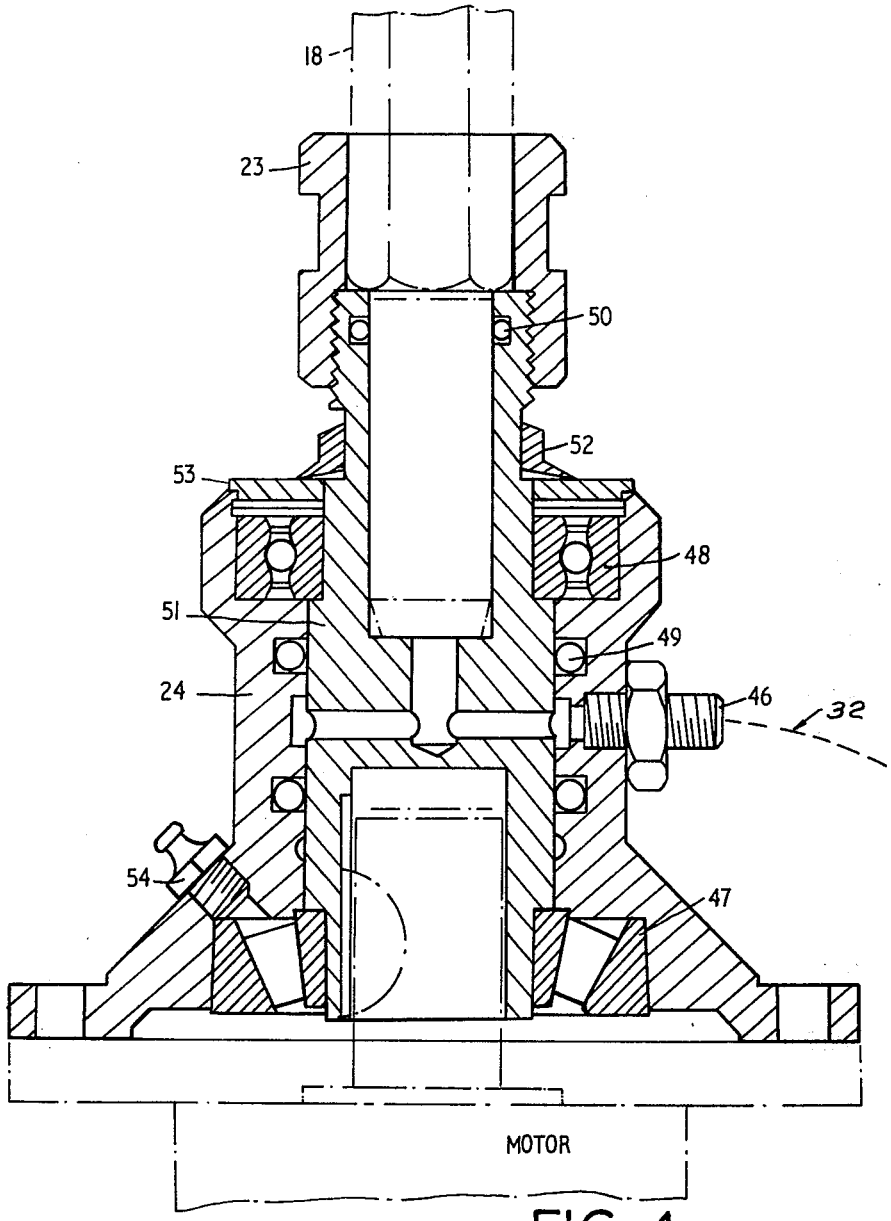
FIG. 4 is a sectional view of the wet drilling unit.

FIG. 4 is a sectional view of the wet drilling unit 24 (FIG. 1). Water for dust suppression and swarf removal is piped to the inlet connection 46 and passes through internal passages to the end of the drill rod 18. The drill unit housing 24 contains bearings 47 and 48 to resist axial thrust and lateral forces respectively. 'O' rings 49 seal the water passages from the bearings and 'O' ring 50 prevents water escaping through the cavity between the drill rod 18 and the spindle 51. The drill collar or chuck 23 is screwed onto spindle 51 and has internal flats to transmit torsional efforts to the hexagonal drill rod 18. A V-ring seal 52 and dust seal plate 53 exclude dust from entering the bearing 48 cavity and a lubrication nipple 54 is provided for the tapered roller race 47.

Figure 5:
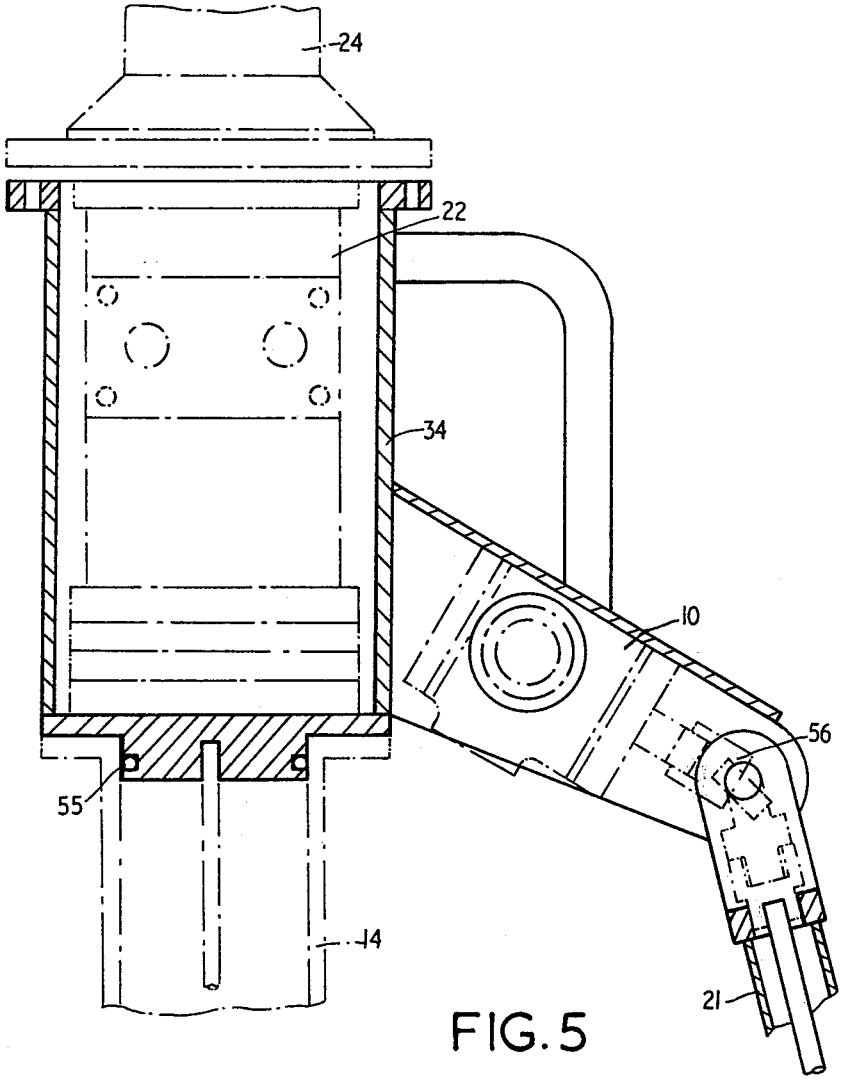
FIG. 5 is a sectional view of the motor shell.

FIG. 5 shows the hydraulic rotation motor 22 mounted within the motor shell 34 thus isolating the motor from the end thrust produced by the leg cylinder 14. The shell 34 is mounted on the leg cylinder 14 incorporating seal 55 and also provides mountings for the wet drilling unit 24. The cowing on the side of the shell 34 provides a protected housing for mounting valve 10. The universal joint 56 transmitting the torsional effort to operate valve 10 and its relative connections to valve 10 and to the pivoted control arm 21 is shown.

Figure 6:
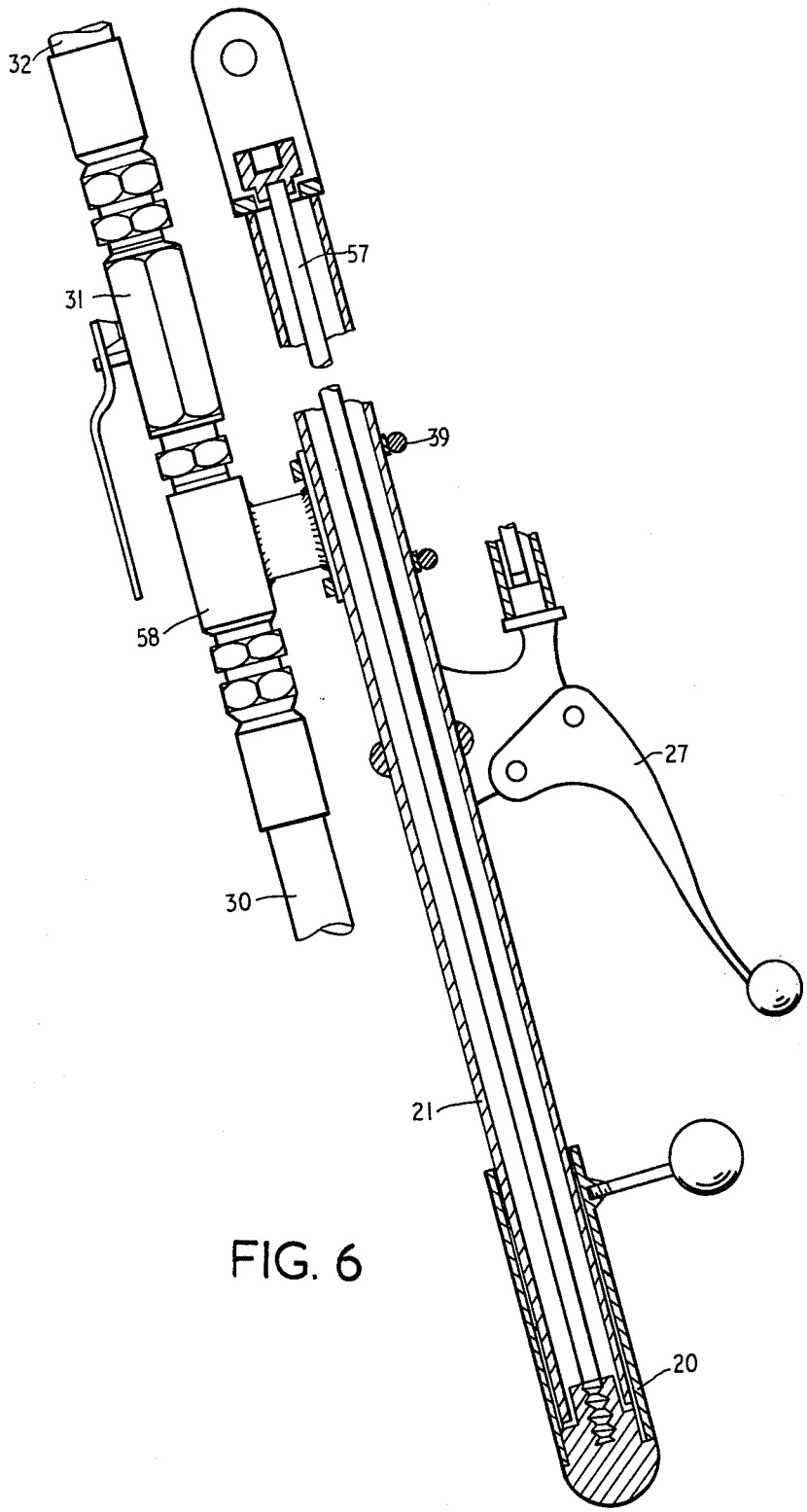
FIG. 6 is a sectional view of the control handle.

FIG. 6 is a part sectional view of the pivoted control arm 21 which provides a means of resisting the torque transmitted by the unit to the pit roof. The arm also provides support for the control handle 27 which activates motor valve 11 (FIG. 1) and the twist grip 20 which controls legs valve 10 (FIG. 1) through the control rod 57 and universal joint 56, (FIG. 5).

The ON/OFF water cock 31, its bracket 58 and connected hoses 30 and 32 are fastened to the control arm 21 with clips 59.

Various lengths of drill rods may be used to produce the desired depth of hole.

The roof drilling machine according to the invention is compact, allowing it to be stowed easily without restricting emergency exits on either side of the coal winning machinery.

It is a unit that can be operated by one person in a position not directly beneath the hole being drilled, thus keeping the operator clear of the swarf and parts of broken roof which may be dislodged during the operation.

Control of the rotation of the drill rod is by means of a "dead man's grip" so as to provide safety for the operator and nearby personnel.

What I claim is:

1. Drilling equipment for drilling holes in mine roofs for the purpose of rock bolting comprising, an intermediate portion having mounted on and extending from it at one end a telescopic leg, a drill rod mounted on and extending from said intermediate portion at the other end thereof, a hydraulic motor mounted on the intermediate portion and coupled to said drill rod, first valve means adapted to be connected to a pressure fluid source for supplying pressure fluid to said leg for extending it or for releasing fluid from said leg, second valve means adapted to be connected to a pressure source for supplying pressure fluid to said hydraulic motor for driving it or for shutting-off the supply of pressure fluid to the motor for stopping it, an elongated torque and control arm pivotally connected at one end to the intermediate portion and having at its outer end means for controlling said first and second valve means independently of each other, whereby an operator is permitted to resist the torque produced by the drill when in operation and allowing the operator to control the drill from a distance.

2. Equipment as in claim 1 wherein the intermediate portion comprises a drilling unit and a shell, said drilling unit being connected at one end to one end of said shell, a spindle rotatably mounted in the drilling unit, means substantially preventing endwise displacement of said spindle in said drilling unit, said spindle being coupled, at one end, to one end of said drill rod, said shell being connected at its other end to the adjacent end of said telescopic leg, said motor being mounted in said shell with the motor shaft extending from said shell into said drilling unit and being coupled to the other end of said spindle.

3. Equipment as in claim 2 wherein said first and second valve means is mounted on said shell.

4. Equipment as in claim 1 wherein said means for controlling said first and second valve means comprises two displaceable control elements coupled respectively to said two valve means and adapted to operate said valve means so as to control the flow of pressure fluid through said valve means.

5. Equipment as in claim 1 wherein said first valve means in one operating position is adapted to receive pressure fluid from the source and to feed it to said telescopic leg and when in another operating position said first valve means is adapted to receive pressure fluid from said telescopic leg and return it to the source.

6. Equipment as in claim 1 wherein said second valve means in one operating position is adapted to receive pressure fluid from the source and feed it to said motor and when in another operating position said second valve means is adapted to divert pressure fluid from said motor and return it to the source.

7. Equipment as in claim 5 wherein said second valve means in one operating position is adapted to receive pressure fluid from the source and feed it to said motor and when in another operating position said second valve means is adapted to divert pressure fluid from said motor and return it to the source.

* * * * *